US005107776A

United States Patent [19]

Garcia-Mallol

[11] Patent Number: 5,107,776

[45] Date of Patent: Apr. 28, 1992

[54] MULTIPLE ADJUSTMENT CYCLONE BURNER

[75] Inventor: Juan A. Garcia-Mallol, Morristown, N.J.

[73] Assignee: Foster Wheeler Energy Corporation, Clinton, N.J.

[21] Appl. No.: 685,760

[22] Filed: Apr. 16, 1991

[51] Int. Cl.[5] ..... F23D 1/02

[52] U.S. Cl. ..... 110/264; 110/263; 110/347; 431/186; 431/189

[58] Field of Search ..... 110/264, 347, 263, 265; 431/8, 9, 10, 185, 186, 189

[56] References Cited

U.S. PATENT DOCUMENTS

| | | | |
|---|---|---|---|
| 1,344,029 | 6/1920 | Fischer . | |
| 3,154,134 | 4/1954 | Bloom . | |
| 3,619,141 | 11/1971 | Henderson et al. . | |
| 3,753,658 | 8/1973 | Henderson et al. . | |
| 3,782,884 | 1/1974 | Shumaker . | |
| 4,146,359 | 3/1979 | Lumpkin et al. | 110/264 X |
| 4,497,263 | 2/1985 | Vatsky et al. | 110/347 |
| 4,627,366 | 12/1986 | LaRue et al. | 110/264 X |
| 4,630,554 | 12/1986 | Sayler et al. . | |
| 4,702,180 | 10/1987 | Kiga | 110/264 X |

*Primary Examiner*—Edward G. Favors
*Attorney, Agent, or Firm*—Marvin A. Naigur

[57] ABSTRACT

A cyclone burner is provided which comprises an outer barrel with first and second ends and an inlet conduit extending tangentially into a side of the barrel for receiving a mixture of fuel and air. A hollow frustocone extends from one of the barrel ends and an injection nozzle extends from the frustum of the frustocone for discharging the mixture into a combustion chamber. A primary air vent extends axially into the other end of the barrel for venting a portion of the mixture. An outer sleeve is connected to a rod which extends through the outer barrel, into the primary air vent, and projects therefrom for actuation of the outer sleeve into the injection nozzle for controlling the amount of discharge of the mixture through the injection nozzle. An inner sleeve retractable into the outer sleeve is connected to a tube in which the inner rod extends. The tube extends through the outer barrel into the primary air vent and projects therefrom for actuation of the inner sleeve into the injection nozzle for further controlling the amount of the discharge.

22 Claims, 1 Drawing Sheet

MULTIPLE ADJUSTMENT CYCLONE BURNER

BACKGROUND OF THE INVENTION

This invention relates to a cyclone burner and, more particularly, to a cyclone burner provided with telescoping cylinders which can be actuated to vary the cross-sectional area of a fuel nozzle.

Pulverized coal furnaces are well-known. In these devices, fuels, such as coal and coke, are first pulverized into a particulate state, then injected into a combustion chamber and finally ignited and burned to produce heat. The fuel is usually pulverized in a mill and then delivered to the furnace suspended in air. It is common to use the same air to grind the fuel, dry it, transport it to the burner and inject it into the combustion chamber This air is commonly referred to as "primary air".

The amount of primary air used to inject fuel into the combustion chamber has been found to be an important variable to the efficiency at which fuel is ignited and consumed. The amount of primary air circulated through the system is not, however, generally variable due to the requirements of the other parts of the system which also use the primary air. Therefore, the ratio of primary air to fuel which would result in the optimal ignition and combustion efficiency is rarely achieved.

Furnace engineers have traditionally designed furnace systems to achieve near optimal combustion efficiency for high quality fuels at normal loads. Low volatile fuels, however, such as anthracite, anthracite silt and coke, which are not easily ignitable, require a decrease in the primary air-to-fuel ratio for efficient ignition and burning. Further, low load burning requires a decrease in the amount of primary air injected into the combustion chamber to offset the decrease in fuel.

To increase the combustion efficiencies while burning low quality fuel or during periods of low load burning, the cyclone burner was developed. Cyclone burners are provided with an air vent which can carry away some of the primary air once the fuel has been transported to the burner. This decreases the primary air-to-fuel ratio of the mixture being injected into the combustion chamber. A further improvement involves the introduction of a substantial amount of relatively hotter air around the fuel injection nozzle and into the combustion chamber. This so-called "sleeve air" can be controlled to increase the combustion efficiency of the fuel.

A cyclone burner used in connection with sleeve air, however, has been found to be unable to provide optimal combustion efficiencies for low quality fuels since these fuels have less volatile matter than other fuels, and therefore require more time to ignite and a longer time to burn for complete combustion. These combustion conditions require that less primary air be injected into the combustion chamber for efficient combustion.

Another problem with the use of cyclone burners arises during low load burning. When the load is decreased, the flow through the burner is less dense due to the increase in the primary air-to-fuel ratio. As density decreases, flow resistance decreases as well. There is thus less resistance to the flow during low load burning as it passes through the injection nozzle. This reduced resistance results in a pressure drop within the injection nozzle which causes more of the primary air to be pulled away from the air vent and into the injection nozzle to balance the pressure differential. Therefore, the amount of air in the injection nozzle during low load burning actually increases rather than merely staying constant. The presence of this additional air, when taken together with the already high primary air-to-fuel ratio present during low load burning, results in an extremely low combustion efficiency.

SUMMARY OF THE INVENTION

It is therefore an object of the present invention to provide a cyclone burner in which the combustion efficiency of particulate fuel is increased during low load burning.

It is a further object of the present invention to provide a cyclone burner of the above type in which the combustion efficiency of low quality fuels is increased.

It is a still further object of the present invention to provide a cyclone burner of the above type in which the ratio of primary air to fuel is variable while the burner is firing.

Toward the fulfillment of these and other objects, the cyclone burner of the present invention is provided with telescoping cylinders which can be placed into an injection nozzle to vary the cross-sectional area of the nozzle. As the area is decreased, the flow resistance through the nozzle increases to reduce the amount of primary air injected into the furnace.

BRIEF DESCRIPTION OF THE DRAWINGS

The above brief description, as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
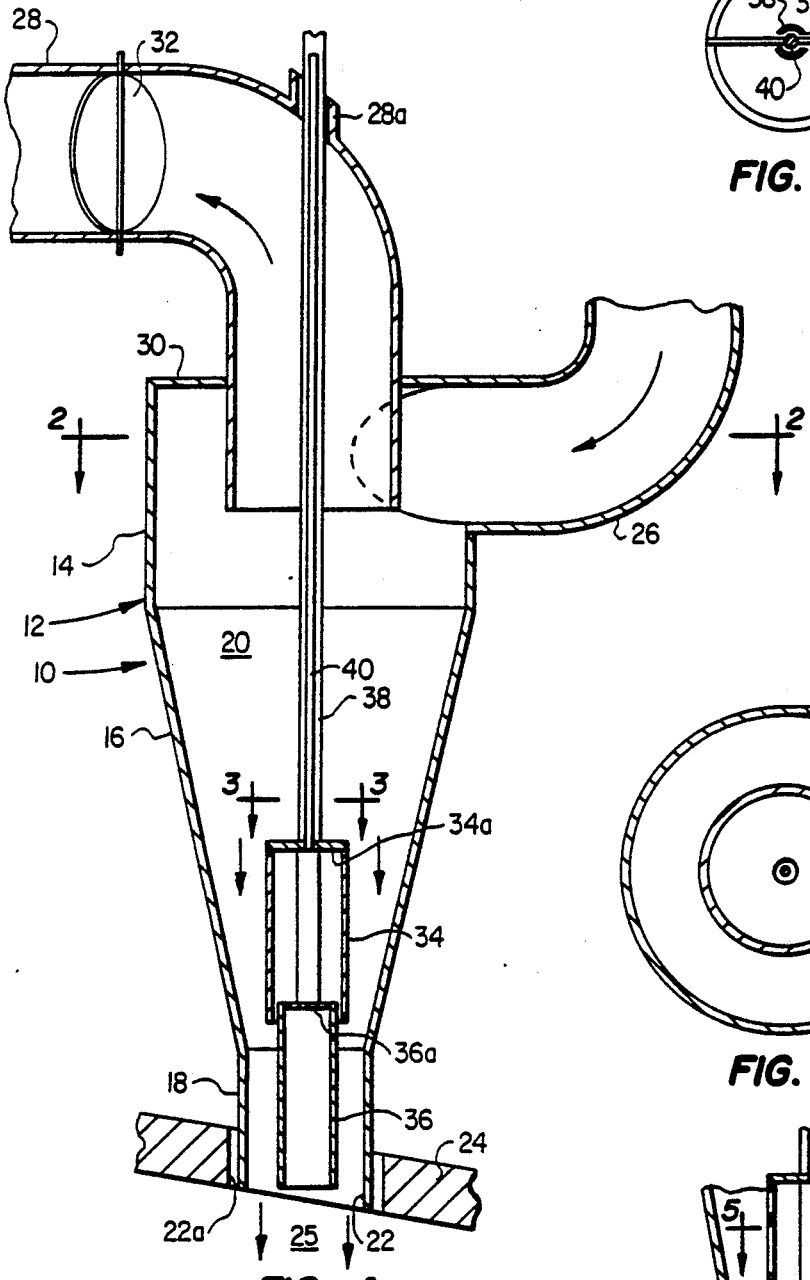
FIG. 1 is a cross-sectional view depicting the cyclone burner of the present invention.

Referring to FIG. 1 of the drawings, the reference numeral 10 refers in general to the cyclone burner of the present invention. The burner 10 includes a housing 12 formed by a cylindrical outer barrel 14, a hollow frustocone 16 and a cylindrical injection nozzle 18. The barrel 14 extends from the base of the cone 16, and the nozzle 18 extends from the frustum of the cone 16 to form a hollow, integral and continuous structure defining a cavity 20.

The nozzle 18 of the burner 10 registers with an inlet 22 in a furnace wall 24. Although not clear from the drawings, it is understood that the wall 24, together with other structures and walls (not shown), define a combustion chamber positioned just below the inlet 22 as viewed in FIG. 1, a portion of which is referred to by the reference numeral 25. As viewed in FIG. 1, the wall 24 is generally horizontal, the combustion chamber 25 extends downwardly from the wall 24 and the burner 10 extends upwardly from and exterior to the combustion chamber. So situated, the burner 10 injects a mixture of particulate fuel and primary air downwardly into the combustion chamber 25 as is more fully described below. It is understood, however, that the burner 10 could also be mounted on a vertical wall or on any angled wall.

The outer diameter of the nozzle 18 is slightly less than the diameter of the inlet 22 to define an annular gap 22a between the wall 24 and the nozzle 18. To help regulate the combustion of the fuel, sleeve air from an external source (not shown) is injected into the combustion chamber 25 through the gap 22a in a conventional manner.

Figure 2:
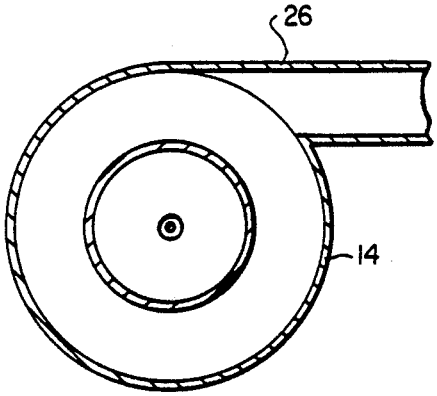
FIG. 2 is a horizontal section taken along the line 2—2 of FIG. 1.

The mixture of particulate fuel and primary air injected by the burner 10 into the combustion chamber 25 enters the burner 10 by means of an inlet conduit 26 extending through a wall in the barrel 14. As shown in FIG. 2, the conduit 26 is in a tangential relationship to the barrel 14, so that the incoming mixture of particulate fuel and primary air swirls around within the cavity 20. The fuel particles, being heavier, are propelled by centrifugal force against the inner wall of the barrel 14, thereby leaving a fuel-deficient, air-rich portion of the mixture in the center of the cavity 20. A majority of this fuel-deficient, air-rich portion can be bled from the burner 10 through a primary air vent 28 which extends axially into the barrel 14 through an end plate 30 which caps the barrel 14. A vent damper 32, suitably mounted within the air vent 28 for pivotal movement about its center in response to actuation of external controls (not shown) to vary the effective opening of the air vent 28, controls the flow of air through the air vent 28.

The structure described thus far is generally known. According to the present invention, an outer sleeve 34 is located in the lower portion of the cone 16 in a coaxial relationship thereto, and an inner sleeve 36 is disposed in a coaxial relationship to the outer sleeve 34 and is adapted to move axially relative to the outer sleeve 34 in a telescoping relationship.

Figure 3:
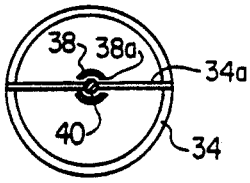
FIG. 3 is a horizontal section taken along the line 3—3 of FIG. 1.

Attached to the inner sleeve 36 by means of an end plate 36a is an outer tube 38 which extends axially through the cavity 20 into the air vent 28 and outwardly thereof through a packing gland 28a in a wall of the air vent. As shown in FIG. 3, two diametrically-opposed, elongated slots 38a are formed in the outer tube 38 for reasons that will be described.

An inner rod 40 is slidably disposed within the outer tube 38 and is connected to the outer sleeve 34 by means of a crossbar 34a. The inner rod 40 extends from the crossbar 34a, through the length of the outer tube 38 and projects from the air vent 28 for actuation thereof. The slots 38a formed in the outer tube 38 allow for relative movement between the outer sleeve 34 and inner sleeve 36 by accommodating vertical movement of the cross bar 34a relative to the outer tube 38.

In operation, the mixture of particulate fuel and primary air is introduced into the conduit 26 from an external source with the primary air carrying the particulate fuel into the barrel 14. Due to the momentum of the particulate fuel and the tangential alignment of the conduit 26 to the barrel 14, the mixture is separated into a fuel-rich portion which swirls around within the cavity 20 and is propelled by centrifugal force against the inner wall of the barrel 14 leaving a fuel-deficient, air-rich portion in the center of the cavity 20. The flow of primary air propels the fuel-rich portion of the mixture downwardly along the inner wall of the cone 16 and the inner wall of the nozzle 18 and then out into the combustion chamber 25 through the inlet 22. The air-rich portion of the mixture also flows through the inlet 22 into the combustion chamber 25. Sleeve air is passed through the gap 22a and into the combustion chamber 25 in a conventional manner as needed to help regulate the combustion of the fuel.

To maintain optimal combustion efficiency, the vent damper 32 can be adjusted to bleed off a portion of the air-rich portion of the mixture in the center of the cavity 20 until the primary air-to-fuel ratio is at an optimal level. However, for the reasons discussed above, during periods of low load or while burning low quality fuels, the air vent 28 is unable to bleed away enough of the air in the burner 10, even with the vent damper 32 fully open, to achieve optimal, or near optimal, combustion efficiency.

To alleviate these problems, the outer and inner sleeves 34 and 36 can be manipulated into the nozzle 18 to further reduce the amount of primary air which is injected into the combustion chamber 25. More particularly, the vent damper 32 is initially fully opened to remove as much of the primary air in the burner 10 through the air vent 28 as possible. To effect a greater reduction in the primary air-to-fuel ratio and to counterbalance the pressure differential seen during low load burning, the inner rod 40 and/or the outer tube 38 are manipulated to place the outer sleeve 34 and/or the inner sleeve 36 into the nozzle 18 to reduce the cross-sectional area of the inlet 22. This reduced area increases the flow resistance through the nozzle 18 and therefore the pressure through the nozzle 18. This pressure increase in turn decreases the amount of the air-rich portion of the fuel-air mixture that is injected into the combustion chamber 25 which thereby decreases the primary air-to-fuel ratio.

The outer sleeve 34 is manipulated into the nozzle 18 to effect a relatively large decrease in the quantity of the air-rich portion of the mixture introduced to the combustor chamber 25. For less of a decrease, only the inner sleeve 36 is introduced into the nozzle 18. If the insertion of the sleeves 34 and 36 result in too great of a reduction in the air-rich portion of the mixture introduced to the combustor chamber 25 and therefore too great of a reduction in the primary air-to-fuel ratio, the vent damper 32 can be partially closed to reduce the amount of air removed through the air vent 28.

Several advantages result from the foregoing. For example, by manipulation of the vent damper 32 in connection with the sleeves 34 and 36, the combustion efficiency of the burner 10 can be optimized under nearly any operating parameters, including the burning of low quality fuels and periods of low load burning. Further, the ratio of primary air-to-fuel can be adjusted while the burner is firing to enable the continuous attainment of optimal combustion efficiencies.

Figure 4:
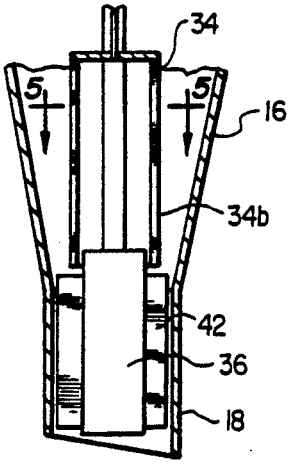
FIG. 4 is a fragmentary view of the burner injection nozzle showing an alternate embodiment.
Figure 5:
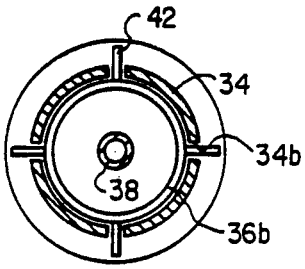
FIG. 5 is a horizontal section taken along the line 5—5 of FIG. 4.

It is understood that several variations may be made in the foregoing without departing from the scope of the present invention. For example, as shown in FIGS. 4 and 5, the inner sleeve 36 can include straightening vanes 42 to decrease the swirling nature of the air-fuel mixture. In order to enable a vaned inner sleeve 36b to still be retractable into the outer sleeve 34, channels 34b are formed into the outer sleeve 34 as shown in FIGS. 4 and 5.

Further, the inner sleeve 36 need not be hollow but can be formed from a solid cylinder. In fact, there need not be two sleeves at all. Although less control over the primary air-to-fuel ratio might result, the employment of a single sleeve, or any object which can restrict flow, in connection with a single manipulated rod or tube would be sufficient to accomplish the purposes of this invention. Also, a single sleeve can be utilized having a stepped outer diameter to enable the amount of reduction of the cross-sectional area of the inlet 22 to be varied accordingly.

Other modifications, changes and substitutions are intended in the foregoing disclosure and although the invention has been described with reference to a specific embodiment, the foregoing description is not to be construed in a limiting sense. Various modifications to the disclosed embodiment as well as alternative applications of the invention will be suggested to persons skilled in the art by the foregoing specification and illustrations. Accordingly, it is appropriate that the appended claims be construed broadly and in a manner consistent with the true scope of the invention therein.

What is claimed is:

1. An apparatus for burning fuel comprising:

means for receiving a mixture of fuel and air and separating said mixture into a first portion which is fuel-rich and a second portion which is air-rich;

means associated with said receiving and separating means for venting a portion of said second portion of said mixture from said apparatus;

means associated with said receiving and separating means for discharging said portions of said mixture from said receiving and separating means for burning said fuel; and means for adjusting the amount of said second portion of said mixture which is discharged from said discharging means for said burning by decreasing the cross-sectional area of the discharging means.

2. The apparatus of claim 1, wherein said receiving and separating means comprises:

a hollow frustocone; and an outer barrel having an inlet for receiving said mixture and first and second ends, said first end extending integrally from the base of said frustocone.

3. The apparatus of claim 2, wherein said inlet is located to deliver said mixture of fuel and air tangentially into said barrel.

4. The apparatus of claim 2, wherein said discharging means comprises an injection nozzle having first and second ends, said first end extending integrally from the frustum of said frustocone and said mixture of fuel and air being discharged through said second end.

5. The apparatus of claim 2, wherein said venting means comprises:

a pipe connected to said barrel for receiving said second portion of said mixture; and control means for controlling the amount of said second portion of said mixture which vents through said pipe.

6. The apparatus of claim 5, wherein said control means comprises a vent damper.

7. The apparatus of claim 1, wherein said adjusting means comprises an outer sleeve and manipulation means connected thereto for manipulating said outer sleeve into said discharging means.

8. The apparatus of claim 7, wherein said manipulation means comprises a rod connected to said outer sleeve, said rod projecting from said receiving and separating means for actuation thereof.

9. The apparatus of claim 7, wherein said outer sleeve further comprises a multiplicity of vanes extending outwardly from said outer sleeve and extending the length of said outer sleeve.

10. The apparatus of claim 8, further comprising an inner sleeve retractable into said outer sleeve and connected to a tube projecting from said receiving and separating means for actuation of said inner sleeve.

11. The apparatus of claim 10, wherein said rod extends within said tube.

12. The apparatus of claim 10, wherein said inner sleeve further comprises a multiplicity of vanes extending outwardly from said inner sleeve and extending the length of said inner sleeve; and said outer sleeve is slotted to provide passages for said vanes of said inner sleeve.

13. An apparatus for burning fuel comprising:

an outer barrel with first and second ends;

an inlet conduit extending tangentially into a side of said barrel for receiving a mixture of fuel and air;

a hollow frustocone extending from one of said barrel ends;

an injection nozzle with first and second ends, said first end extending integrally from the frustum of said frustocone for discharging said mixture into a combustion chamber;

a primary air vent extending axially into the other end of said barrel for venting a portion of said mixture;

a damper interposed in said air vent for controlling the amount of said venting;

an outer sleeve connected to a rod which extends through said barrel into said primary air vent and projects therefrom for actuation of said outer sleeve into said injection nozzle for controlling the amount of discharge of said mixture from said injection nozzle; and an inner sleeve retractable into said outer sleeve and connected to a tube in which said inner rod extends, said tube extending through said barrel into said primary air vent and projecting therefrom for actuation of said inner sleeve into said injection nozzle for further controlling the amount of said discharge.

14. The apparatus of claim 13 where said outer sleeve reduces said discharge a relatively large amount and said inner sleeve reduces said discharge a relatively small amount.

15. The apparatus of claim 13, wherein said inner sleeve further comprises a multiplicity of vanes extending outwardly from said inner sleeve and extending the length of said inner sleeve; and said outer sleeve is slotted to provide passages for said vanes of said inner sleeve.

16. An improved apparatus for burning fuel of the type in which a received mixture of fuel and air is separated into a first portion which is fuel-rich and a second portion which is air-rich where a portion of said second portion is vented from said apparatus and said first portion and the remaining portion of said second portion is discharged from said apparatus via a nozzle for burning, wherein the improvement comprises:

means for adjusting flow resistance through said nozzle to vary the amount of said second portion which is discharged from said apparatus for said burning.

17. The apparatus of claim 16, wherein said adjusting means comprises an outer sleeve and manipulation means connected thereto for manipulating said outer sleeve into said discharging means.

18. The apparatus of claim 17, wherein said manipulation means comprises a rod connected to said outer sleeve, said rod projecting from said apparatus for actuation thereof.

19. The apparatus of claim 17, wherein said outer sleeve further comprises a multiplicity of vanes extending outwardly from said outer sleeve and extending the length of said outer sleeve.

20. The apparatus of claim 18, further comprising an inner sleeve retractable into said outer sleeve and connected to a tube projecting from said apparatus for actuation of said inner sleeve.

21. The apparatus of claim 20, wherein said rod extends within said tube.

22. The apparatus of claim 21, wherein said inner sleeve further comprises a multiplicity of vanes extending outwardly from said inner sleeve and extending the length of said inner sleeve; and said outer sleeve is slotted to provide passages for said vanes of said inner sleeve.

* * * * *